United States Patent [19]

Comploi et al.

[11] 4,426,941

[45] Jan. 24, 1984

[54] EMBROIDERY MACHINE PATTERN MECHANISM

[75] Inventors: Georg Comploi, Bludenz, Austria; Roland Heimgartner, Arbon, Switzerland; Artur Loacker, Goetzis, Austria; Kurt Huber, Arbon; Hans Wallimann, Goldach, both of Switzerland

[73] Assignee: Aktiengesellschaft Adolf Saurer, Arbon, Switzerland

[21] Appl. No.: 345,091

[22] Filed: Feb. 2, 1982

[30] Foreign Application Priority Data

Feb. 4, 1981 [CH] Switzerland ..... 730/81

[51] Int. Cl.[3] ..... D05C 11/06

[52] U.S. Cl. ..... 112/84

[58] Field of Search ..... 112/79 A, 84, 221, 98, 112/78; 66/232

[56] References Cited

U.S. PATENT DOCUMENTS 3,608,336 9/1971 Phillips ..... 66/232

FOREIGN PATENT DOCUMENTS 718816 3/1942 Fed. Rep. of Germany ..... 66/232

3023160 1/1981 Fed. Rep. of Germany ..... 112/78

2938903 4/1981 Fed. Rep. of Germany ..... 112/78

165789 12/1933 Switzerland .

488043 5/1970 Switzerland .

515372 12/1971 Switzerland .

*Primary Examiner*—Werner H. Schroeder

*Assistant Examiner*—Andrew M. Falik

*Attorney, Agent, or Firm*—Werner W. Kleeman

[57] ABSTRACT

At an embroidery machine there are mounted and displaceably guided two rows of embroidering implement rods which can be connected so as to be operatively coupled or decoupled in accordance with a desired program to a related one of two operatively associated oscillating drive rails. The embroidering implement rods which are related to the same embroidery location or position and which are, for instance, arranged in superimposed relation, can be simultaneously coupled to or decoupled from the operatively associated drive rail by means of a common switching lever. This switching lever can be actuated either directly or manually by means of adjustment levers and automatically by means of an electromagnetic device. This individual switching of all implements of an embroidery location enables easily adjusting any desired combination of working and inactive embroidery locations.

16 Claims, 5 Drawing Figures

FIG.1
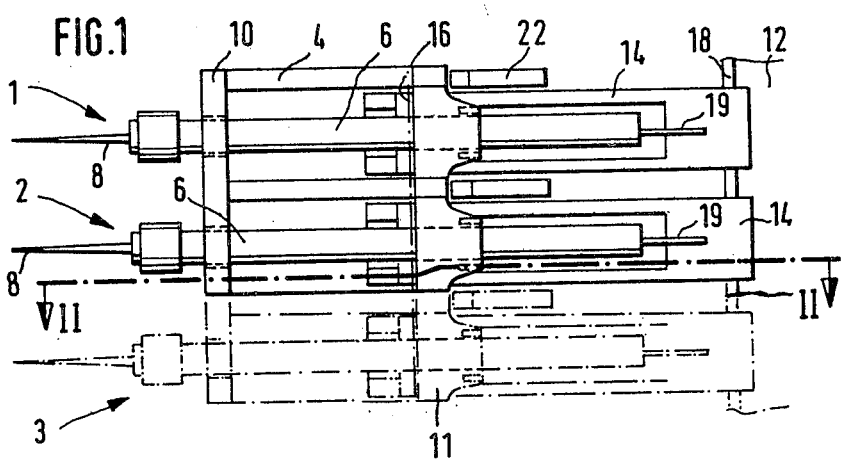
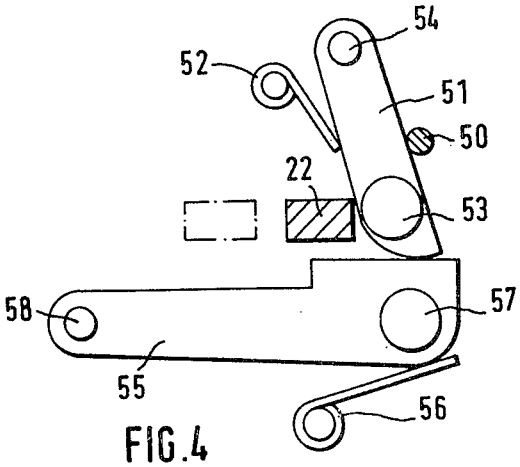
FIG.4
FIG.5
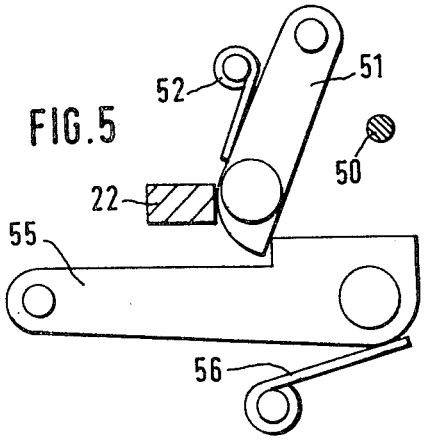

EMBROIDERY MACHINE PATTERN MECHANISM

CROSS-REFERENCE TO RELATED APPLICATION

This application is related to our commonly assigned, copending United States application Ser. No. 06/345,080, filed Feb. 2, 1982, entitled "Electromagnetic Pattern Selector For A Embroidery Machine".

BACKGROUND OF THE INVENTION

The present invention relates to a new and improved construction of embroidery machine comprising embroidering implement rods which are mounted and displaceably guided in at least two rows at the embroidery machine, wherein such embroidering implement rods can be connected according to a program to an operatively associated drive rail or track so as to be coupled thereto or decoupled therefrom.

With embroidery machines, especially large embroidery machines of the aforementioned type, the embroidery work is carried out with various repeats, according to the width of the pattern to be embroidered. The term "repeat" as used herein refers to the lateral distance or spacing between the embroidery locations in operation, i.e. between the embroidering tools or implements, the needles, borers or the like. When converting the embroidery machine to a different pattern, the embroidering implements of those embroidery locations which previously were inactive or resting have to be rendered effective and the embroidering implements of embroidery locations which previously were working or active have to be rendered inactive, according to the different or other repeat.

Therefore, there have been known for quite some time various devices which render possible switching-in or activating and switching-out or deactivating individual needles, whether such switching functions be performed manually or by means of mechanically controlled apparatuses.

One such type of manual individual needle switching device has been disclosed in Swiss Patent No. 165,789 granted Dec. 15, 1933.

In Swiss Patent No. 515,372, granted Nov. 15, 1971 there has been disclosed a mechanical switching device for a color and repeat change, which is combined with a manual switching device.

However, with these prior art devices only the needles are switched-in or activated and switched-out or deactivated. Corresponding switching devices for the borers are not provided or they are constructed such that there only is possible the switching of very few combinations, such as disclosed, for instance, in Swiss Patent No. 488,043, granted Mar. 31, 1970.

In contrast thereto, there has been described in German Patent Publication No. 3,023,160, published Jan. 8, 1981 a solution for switching over, according to a program, between the needle and borer and vice versa at every active embroidery location of a Schiffle embroidery machine. In this instance, a common single drive rail serves for actuating both the needles and the borers which are supported by separately displaceable needle bars or borer bars, respectively. For the alternate coupling and decoupling of the borer or the needle at the effective embroidery locations there is provided a control shaft which carries offset cams. In one position this control shaft disengages the needle bars of the active embroidery location from the drive rail and in another position disengages the borer bars of the same embroidery location from the drive rail. There is not provided a possibility, for instance with a repeat change, to activate or deactivate embroidery locations with their borers and needles so as to carry out a different embroidery program.

SUMMARY OF THE INVENTION

Therefore, it is a primary object of the present invention to provide a new and improved construction of embroidery machine of the initially mentioned type, which avoids the aforementioned drawbacks and shortcomings of the prior art constructions.

Another important object of the present invention is to provide a new and improved construction of embroidery machine of the initially mentioned type, wherein all embroidering implements of an embroidery location can be commonly switched, which is the only sensible technique as concerns the embroidery process.

Now in order to implement these objects and others which will become more readily apparent as the description proceeds, the embroidery machine according to the present invention is manifested by the features that the embroidering implements which are related to the same embroidery position or location can be simultaneously coupled to or decoupled from the operatively associated drive rail or track by means of a switching lever. This switching lever can be actuated manually, i.e. directly or by means of manual adjustment or positioning levers, and automatically by means of an electromagnetic device.

Being able to individually switch the embroidery locations, together with all implements related thereto, both manually and automatically enables setting any desired combination of working or active, i.e. embroidering, and inactive or resting, i.e. non-embroidering embroidery locations.

In this regard, it is especially advantageous if the switching lever cannot be actuated by means of the electromagnetic device when the fomer is located in a manually induced arrested end position which causes the embroidery implement rods to be decoupled from the related drive rails or tracks.

In order to attain the smallest possible structural size or space requirements, it is advantageous if the electromagnetic device forms a part of an adjustment or positioning device for a related switching lever, which further comprises a mechanical device which is in operative association or connection with the electromagnetic device. A pawl lever cooperates with the switching lever and can be adjusted by means of the electromagnetic device between a first end position and an intermediate position, and by means of the mechanical device between the intermediate position and a second end position. This construction renders possible an especially low-power automatic initiation of the repeat alteration at very low energy expenditure or requirements.

A further advantageous construction can be attained in that there is hinged to each embroidering implement rod a pawl or latching element which is provided at its free end with a downwardly open groove or recess for latching or engaging with a coupling nose at the related drive rail or track. According to one embodiment of the invention the pawls or latching elements are provided with inclined or oblique extending control surfaces which, for the decoupling or disconnecting operation, coact with corresponding control surfaces provided at a transverse web or portion of the common switching lever. With this construction manual switching operations can be performed even when the machine is in operation. If, furthermore, the coupling grooves provided at the pawls or latching elements are located in the lengthwise axis of the embroidering implement rods and if the coupling grooves and the coupling noses are constructed so that they fit into each other in a wedge-shaped fashion and have a wedge angle which is approximately equal to the friction angle, then there is achieved an arrangement which is practically free from play and wherein there occurs practically no transverse forces.

Preferably the switching lever extends upwardly above the upper bar row with a first manual adjustment or positioning arm and with a second positioning or adjustment arm extends downwardly below the lower bar row.

It is beneficial if by means of manual-positioning lever means the switching lever can be releasably arrested through its manual positioning arm in an end position which causes the embroidering implement rods to be decoupled or disconnected from the related drive rails.

An advantageous construction of the automatic positioning or adjustment device for the switching lever can be achieved in that the pawl lever carries at its one free end a permanent magnet which constantly adheres to the iron core of the unexcited electromagnet and if a mechanical amplifier which cooperates with the pawl lever contains an externally actuatable tilt or pivot lever. By pivoting this tilt lever the pawl lever can be moved from its intermediate position into the second end position.

An arrangement which is especially maintenance-favorable and reduces the standstill periods of the embroidery machine is attained when a number of embroidery locations are combined into a block unit and arranged in a bearing housing. These bearing housings preferably are exchangeably mounted upon a support rail provided at the embroidery machine.

BRIEF DESCRIPTION OF THE DRAWINGS

The invention will be better understood and objects other than those set forth above will become apparent when consideration is given to the following detailed description thereof. Such description makes reference to the annexed drawings which depict exemplary embodiments of the present invention and wherein:

FIG. 1 illustrates an embroidery machine which has been depicted in schematic top plan view and portraying a portion of an embroidering implement row;

FIG. 4 shows a modified construction of a detail of the arrangement according to FIG. 2 on an enlarged scale and in a first functional position; and FIG. 5 is an illustration of the arrangement according to FIG. 4 in a second functional position.

DETAILED DESCRIPTION OF THE PREFERRED EMBODIMENTS

Figure 3:
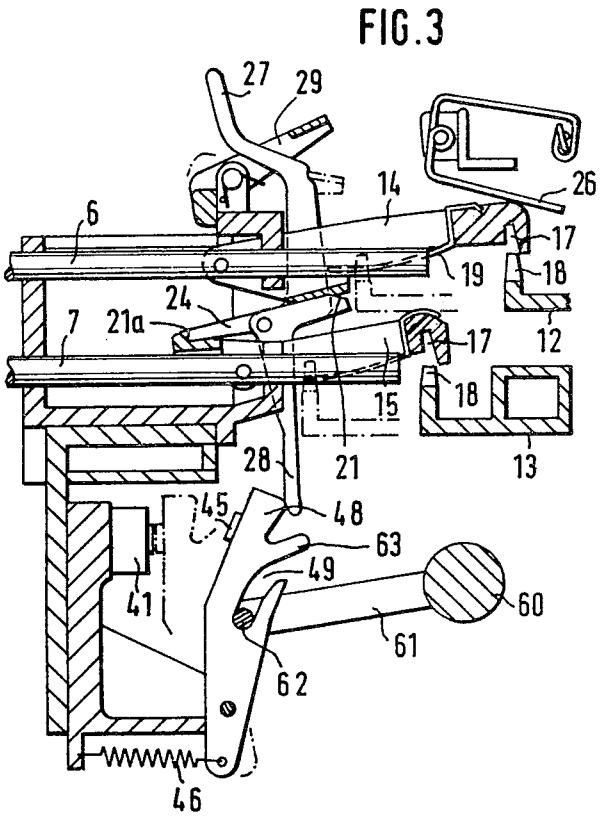
FIG. 3 is an illustration corresponding to the illustration of FIG. 2 but here showing the embroidering implements of an embroidery location in a different position, i.e. in an inactive or rest position.

Describing now the drawings, it is to be understood that only enough of the construction of the embroidery machine has been illustrated therein as needed for those skilled in the art to readily understand the underlying principles and concepts of the invention, while simplifying the illustration of the drawings. The embroidery machine illustrated in FIGS. 1, 2 and 3 has been represented generally in FIG. 1 by means of three embroidery positions or locations 1, 2 and 3. Of course, an embroidery machine of the type under discussion would contain a considerable multiple of such embroidery locations per row, for instance 300 to 1000. It is beneficial if for a plurality of embroidery locations, for instance as in the embodiment under discussion, always two embroidery locations or positions are combined into a block unit or module and arranged in a bearing housing 4. A corresponding number of these bearing housings 4 are then arranged adjacent to one another and preferably so as to be exchangeable upon a support or carrier rail 5 (FIG. 2) provided at the embroidery machine.

Figure 2:
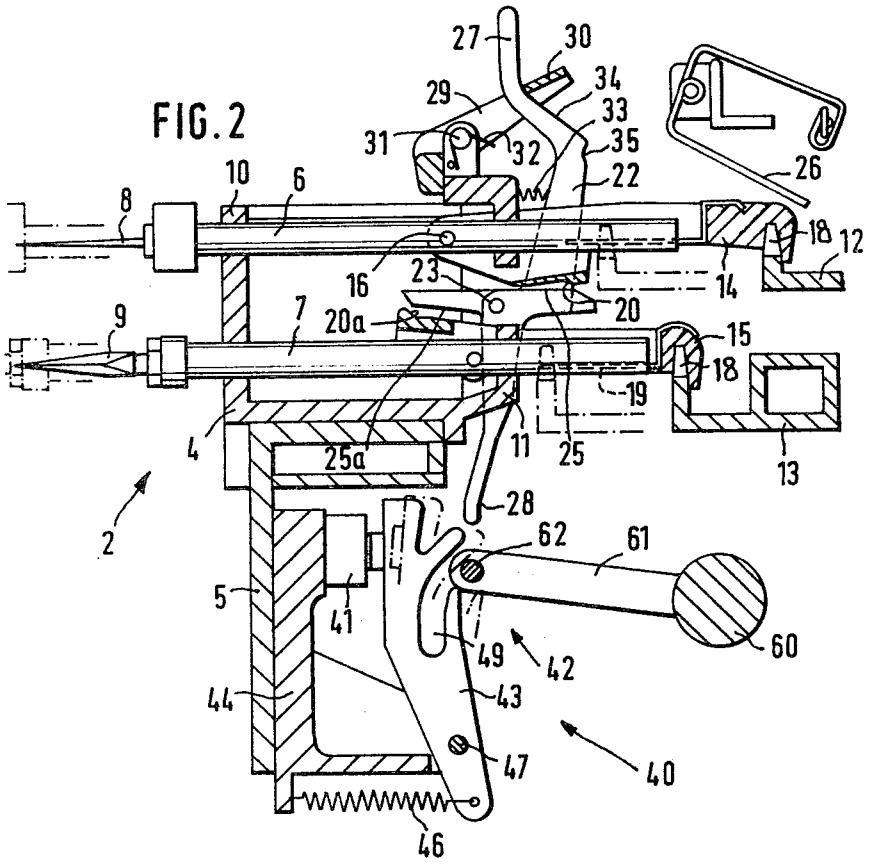
FIG. 2 is a sectional view taken substantially along line II—II of FIG. 1 and serving to illustrate the embroidering implements of an embroidery location in a first functional position, i.e. in an active or working position.

By referring to FIGS. 2 and 3 it will be seen that each embroidery location or position comprises two essentially horizontally extending embroidering implement rods or bars 6 and 7 which, in the embodiment under discussion, are arranged in superimposed manner. These embroidering implement rods or bars 6 and 7 carry various embroidering implements or tools, e.g. rod 6 carries a needle 8 and rod 7 carries a borer 9 or equivalent structure. The embroidering implement rods 6 and 7 are displaceably guided in any suitable not particularly referenced lubrication-free guides provided at the lateral or side walls 10 and 11, respectively, and can be moved to-and-fro in the direction of their lengthwise axis in a manner described hereinafter in greater detail. The actuation of the needle bar 6 is performed by a drive rail 12 for the needles 8 and the actuation of the borer bar 7 by a drive rail 13 for the borers 9. These drive rails 12 and 13 can be appropriately displaced in transverse direction, so that they perform an oscillating to-and-fro motion, which displacement is of conventional nature and therefore need not here be further explained. The elements which cause the needle bars 6 to be decoupled from or coupled to the drive rail 12 and the borer bars 7 to be decoupled from or coupled to the drive rail 13 encompass a needle bar pawl or latching element 14 and a borer bar pawl or latching element 15, respectively. With one of their ends these latch elements or pawls 14 and 15, respectively, are hinged to the related rod 6 and 7, respectively, by means of a pivot pin or plug 16. At each of their free ends the pawls 14 and 15 are provided with a downwardly open groove 17 for engaging over a related nose 18 provided at the respective drive rail 12 and 13. By means of springs 19 or the like the pawls or latching elements 14 and 15 are pre-biased at their related rods 6 and 7 in clockwise direction, and thus, are urged in the direction of their coupling or engagement position. The rods 6 and 7 can be decoupled or disengaged from their drive rails 12 and 13, respectively, by lifting the respective pawls or latching elements 14 and 15 against the action of the related spring 19. For this purpose, the latching elements or pawls 14 and 15 are provided at their lower side and at their upper side, respectively, with an inclined or obliquely extending control surface 20 and 20*a*, respectively. In a manner to be more fully described hereinafter, these control surfaces 20 and 20*a*, respectively, cooperate with a respective control surface 21 and 21*a* provided at a transverse web 24 of a switching lever 22.

The aforementioned switching lever 22 is appropriately supported at the bearing housing 4 so as to be pivotable about a pivot pin 23 or the like from the position illustrated in FIG. 2 into the position illustrated in FIG. 3 and vice versa. For each embroidery location or position there is provided one such switching lever 22, by means of which, according to the invention, the superimposed embroidering implement rods 6 and 7 are simultaneously coupled to or decoupled from the related drive rail 12 and 13, respectively. If the switching lever 22 is pivoted counterclockwise out of the position illustrated in FIG. 2, then there occurs by means of the aforedescribed control surfaces 20, 21 and 20*a*, 21*a*, respectively, a decoupling lifting-off or disengagement of the pawls or latching elements 14 and 15 into the position illustrated in FIG. 3. Conversely, there occurs a recoupling or reengagement of the embroidering implement rods 6 and 7 when the switching lever 22 is pivoted back into the position illustrated in FIG. 2.

At this point it should be remarked that the coupling grooves or recesses 17 provided at the pawls or latching elements 14 and 15 are located in the lengthwise axis of the needle bars 6 and the borer bars 7, respectively. Thus, the application of transverse forces upon the bearing and connection means are avoided during the transmission of motion from the drive rails 12 and 13 to the rods 6 and 7, respectively.

Furthermore, it is beneficial if, as in the embodiment of the invention under discussion, the coupling grooves or recesses 17 provided at the pawls or latching elements 14 and 15 and the corresponding coupling noses 18 provided at the drive rails 12 and 13 are constructed so that they fit into each other in a wedge-shaped fashion. Under the action of the pre-biasing springs 19 there is thus achieved a connection between the pawls or latching elements 14 and 15 and the corresponding drive rails 12 and 13, respectively, which is essentially free from play. In this regard it is beneficial to select a wedge angle which is approximately equal to the friction angle, so that clamping or binding is avoided. Since, as previously mentioned, there also occur no transverse forces, this connection always can be easily released.

Furthermore, it is advantageous if the control surfaces 20 and 20*a* provided at the pawls 14 and 15 and the control surfaces 21 and 21*a* provided at the transverse web or portion 24 of the switching lever 22, respectively, are constructed in a substantially saddle-like fashion transversely to the displacement direction. Together with the action of the springs 19, which engage at the pawls or latching elements 14 and 15, this results in an axial arresting or fixation in the decoupling or inactive position illustrated in FIG. 3.

Moreover, the design is carried out such that the run-on or contact surfaces 25 and 25*a* provided at the transverse web 24 of the switching lever 22 form an inclined or oblique plane when the switching lever is located in the inactive or rest position shown in FIG. 3. Consequently, the corresponding pawls or latching elements 14 and 15 can be decoupled in an impact-free and oscillation-free manner during the course of a possible return movement of the embroidering implement rods 6 and 7 after the switching lever 22 has been moved to the rest position. This enables moving the switching lever 22 into its rest or inactive position even when the machine is in operation.

Owing to the aforedescribed arrangement it furthermore is possible that, without employing further intermediate elements or additional switching elements, the thread stop motion lamella or wire 26 operatively associated with each embroidery location of the machine can be directly switched-out by means of the needle bar pawl or latching element 14, if there occurs a decoupling of this pawl 14 according to the showing of FIG. 3.

Moreover, it is significant that for coupling the embroidering implement rods 6 and 7 of each embroidery location or position to the drive rails 12 and 13 and for decoupling the same therefrom, respectively, the switching lever 22, which is common to both these implement rods 6 and 7, can be actuated both manually by means of manual positoning or adjustment means to be more fully described hereinafter and automatically by means of a positioning or adjustment device 40 likewise to be more fully described hereinafter. This enables switching any conceivable combination of working (embroidering) and inactive or resting (non-embroidering) embroidery locations at the machine, which renders possible a practically unlimited choice of repeats.

For the manual adjustment or positioning and the automatic adjustment or positioning by means of the automatic adjustment or positioning device 40 the switching lever 22 extends upwards by means of a first manual positioning arm 27 above the row of upper embroidering implement rods 6 and by means of a second positioning arm 28 extends downwards below the row of the lower embroidering implement rods 7. For manually pivoting the switching lever 22 out of the work position of the corresponding embroidery location, i.e. out of the active or work position illustrated in FIG. 2, into the rest position illustrated in FIG. 3, there is here employed a manual switching rocker or manipulator element 29 which is provided with a latching or locking nose 30 and which is mounted at the bearing housing 4, so as to be pivotable about a pivot pin 31. This manual switching rocker 29 is pre-biased in counterclockwise direction by means of a spring 32 or equivalent structure. In contrast thereto, the switching lever 22 is pre-biased in the clockwise sense by means of a spring 33 or the like, wherein the latching or locking nose 30 provided at the manual switching rocker 29 serves as a stop for the switching lever 22, as will best be seen by referring to FIG. 2. For manually decoupling or switching-out the switching lever 22 the switching rocker 29 must be pressed downwards, whereby the latching or locking nose 30 pushes away the switching lever 22, in the counterclockwise sense, over an inclined control surface 34, until the latching or locking nose 30 can jump into a latching or catch groove 35 or the like provided at the switching lever 22.

Consequently, there is attained the rest or inactive position illustrated in FIG. 3 and described above in greater detail. It is to be understood that the positioning arm 28, which is operatively connected or associated with the positioning or adjustment device 40 in a manner still to be more fully described hereinafter, equally has moved from the position illustrated in FIG. 2 to the so-called rest or ineffectual position according to FIG. 3.

In order to manually bring back the relevant embroidery location to the work position it is sufficient to slightly touch the manual positioning arm 28 of the switching lever 22 and to slightly press it towards the left side according to the drawing. Hence, the locking nose 30 is disengaged from or cammed out of the latching groove or device 35 and the switching rocker 29 can jump back under the action of its pre-biasing spring 32. With the subsequent disengagement of the switching lever 22 the same jumps back into its former position under the action of its return spring 33. As a consequence, the latching elements or pawls 14 and 15 are disengaged in the aforedescribed manner from the transverse web 24 of the switching lever 22 and are coupled to the respective drive rail 12 and 13 under the action of their related pre-biasing spring 19.

With a modified embodiment of the present invention according to FIGS. 4 and 5 the switching lever 22 equally can be pressed into its rest or inactive position illustrated in FIG. 3 and arrested in this rest position by means of a lever arrangement composed of the levers 51 and 55. For this purpose, the lever 51, which can be pivotably mounted at one end about a pivot pin 54 against the action of a spring 52, is pivoted away at its handle bar 53 or the like from the stop 50 into the end position illustrated in FIG. 5. In this position a locking pawl lever 55, which is pivotably hinged to a pivot pin 58, can engage in a latching fashion rearwardly at the lever 51 under the action of its pre-biasing spring 56.

In order to restore the initial position, the locking or latching pawl lever 55 simply needs to be briefly depressed at its handle bar 57, whereupon the entire arrangement returns back into the initial position illustrated in FIG. 4.

Of course, it is to be understood that in all other respects the resultant movements at the switching lever 22 correspond to the movements occurring with the aforedescribed embodiment of the invention described with reference to FIGS. 2 and 3.

As previously mentioned, the automatic actuation of the switching lever 22 is performed by means of the automatic positioning or adjustment device 40 by means of the positioning arm 28. However, this is not the case when the switching lever 22 is located in the arrested rest position, which has been induced manually in the manner described further above and which inactive or rest position causes the embroidering implement rods 5 and 7 to be decoupled from the corresponding drive rails 13 and 14, as will be easily recognized by referring to FIG. 3.

In principle, the automatic positioning or adjustment device 40 could be formed by a servo motor or an electromagnet which directly or indirectly acts upon the positioning arm 28 of the switching lever 22. However, such arrangement would require powerful and thus voluminous, complicated positioning units which, with respect to the great number of embroidering implements to be coupled or engaged, additionally would require a large electrical power supply.

In order to avoid this, the positioning or adjustment device 40 comprises an electromagnetic device 41 which via a pawl lever 43 cooperates with a so-called mechanical amplifier 42. The pawl lever 43 directly engages at the positioning arm 28 of the switching lever 22.

According to the showing of FIGS. 2 and 3 the positioning or adjustment device 40 specifically comprises a relatively small electromagnet 41 for each embroidery location and which electromagnet 41 is secured to a support 44 provided at the support or carrier rail 5. This electromagnet 41 cooperates with the pawl lever 43 such that this pawl lever 43 carries at its free end a permanent magnet 45 which adheres to the iron core of the non-energized electromagnet 41 and, specifically, against the action of a positioning spring 46. This positioning spring 46 engages at the other end of the pawl lever 43 which is mounted at the support 44 so as to be pivotable about a pivot pin or plug 47. At its upper end the pawl lever 43 carries an actuation nose 48 or equivalent structure which forms an entrainment connection with the positioning arm 28 of the switching lever 22.

The mechanical amplifier 42, which cooperates with the pawl lever 43, comprises a switching shaft 60 which preferably is common to all embroidery locations. By means of a lever means 61 this switching shaft 60 carries a switching rod or bar 62 which preferably is equally common to all embroidery locations. By downwardly pivoting this switching rod 62 by rotating the switching shaft 60 in the counterclockwise rotational sense the switching rod 62 can enter a positioning slot 49 provided at each pawl lever 43, and thus, can further entrain this pawl lever 43 for movement in the clockwise direction if previously the same has been brought into the effective region of the switching rod 62, for instance into the position indicated by dot-dash lines in FIG. 2. In this position a stop or impact nose 63 provided at the pawl lever 43 bears against the switching rod or bar 62.

The permanent magnet 45 arranged at the pawl lever 43 adheres to the electromagnet for as long as the same is without current. For this period of time, the pawl lever 43 equally remains arrested against the action of its positioning spring 46 in the position illustrated in FIG. 2. In this position the switching rod 62 is out of engagement with the positioning or adjustment slot 49 provided at the pawl lever 43. The actuation nose 48 at the pawl lever 43 is spaced at a predetermined distance from the actuatable positioning arm 28 of the switching lever 22.

This aforementioned distance or spacing between the actuation nose 48 and the switching lever 22 to be actuated corresponds at least to a first displacement path, through which the pawl lever 43 has to move so that, after moving from its rest position according to FIG. 1 into the aforementioned dash-dotted or phantom line intermediate position, it comes to stop at the switching rod 62 which is arranged at the mechanical amplifier 40.

This displacement of the pawl lever 43 from its first end position to the aforementioned intermediate position is performed in that the electromagnet 41 is activated by a current pulse, which causes the permanent magnet 45 at the pawl lever 43 to the repelled and the pawl lever 43 thus is pivoted into the aforementioned intermediate position. For this purpose it only is necessary to briefly build-up at the electromagnet 41 a magnetic field which is capable of attenuating the permanent magnetic field to an extent such that the spring 46 can pivot away the pawl lever 43, as aforedescribed. For this operation there can be used even very small electromagnets which require only minimal energy.

Only when the pawl lever 43 has arrived at its intermediate position is it further pivoted, by means of the action of the mechanical amplifier 40, out of this intermediate position into the other end position illustrated in FIG. 3. It is only here that there is effected the necessary positioning or displacement work at the switching lever 22 and the embroidering implements are then brought out of engagement with the drive rails 12 and 13 in the aforedescribed manner and arrested by means of the switching rod 62.

In the embodiment of the invention under discussion the arrangement is chosen such that the positional adjustment or displacement of the pawl lever 43 from the intermediate position into the work position according to FIG. 3 is performed idly and without effect upon the switching lever 22 if the same is already located in the rest or inactive position according to FIG. 3. This rest position has been manually initiated in the aforedescribed manner and positionally arrested by virtue of the engagement of the locking nose 30 provided at the manual switching rocker 29 with the latching groove or device 35 provided at the switching lever 22.

Furthermore, the construction of the positioning or adjustment device 40 is undertaken such that the switching rod 62 can be moved past those pawl levers 43 which are located in their rest position according to FIG. 2.

These measures enable switching any conceivable combination of working (embroidering) and resting (non-embroidering) embroidering implements.

In order to set a new repeat, all relevant pawl levers 43 initially are moved from the work position according to the showing of FIG. 3 into the intermediate position according to the showing of FIG. 2 by upwardly pivoting the switching rod or bar 62. Owing to the effect of the magnetic field between the permanent magnet 45 and the electromagnet 41, the pawl levers 43 automatically pass through the remainder of the displacement path into the aforedescribed contact position. Hence, all embroidering implements are located in their embroidering work or effectual position, unless they have been arrested in their non-embroidering position through a manual switching-out operation.

For the new repeat there are now activated or energized all those electromagnets 41 which are located at embroidery locations which are required to be non-embroidering for this new repeat. Thus, in the manner already described in detail heretofore, the corresponding embroidering implements are then simultaneously placed in their ineffectual position by means of the mechanical amplifier 40 and by the action of the switching lever 22.

In this regard, it should be evident that all electromagnets arranged at the numerous embroidery locations of an embroidery machine can be individually actuated by means of a herein not further illustrated control device. Such central control or control device equally allows for the actuation of the generally motor-driven drive of the switching shaft 60, which drive can be of any suitable type and therefore has not been particularly illustrated in the drawings.

As initially mentioned, the aforedescribed arrangement additionally enables dividing all embroidery locations into groups. These groups, with all the positioning means and functional elements related thereto, are combined into block units which are arranged in bearing housings 4 and conveniently mounted upon the support rail 5.

Among other things, this allows for a rational preassembly and an easy replacement of defective or malfunctioning units or parts at the embroidery machine. In order to keep the moving masses as small as possible, it is beneficial to construct the drive rails 12 and 13 as hollow profiles or sectional elements and to form the pawls or latching elements 14 and 15 of plastic material and the embroidering implement rods 6 and 7 of aluminium pipe, for instance.

Furthermore, it is advantageous if all embroidery locations from the first to the last needle are consecutively numbered in a clearly visible manner. This enables manually and rapidly feeding in each repeat according to numerical tables in that there are actuated in the aforedescribed manner all those manual switching rockers 29 whose operatively associated embroidering implement rods 6 and 7 are to be arrested in a non-embroidering position or mode by means of the related switching lever 22.

While there are shown and described present preferred embodiments of the invention, it is to be distinctly understood that the invention is not limited thereto but may be embodied and practiced within the scope of the following claims. Accordingly,

What we claim is:

1. An embroidery machine comprising:

embroidering implement rods mounted in at least two rows and displaceably guided at the embroidery machine;

a respective oscillatingly driven drive rail operatively associated with at least predetermined ones of the embroidering implement rods of a given row;

each of said embroidering implement rods being operatively connectable with its operatively associated oscillatingly driven drive rail in that each said embroidering implement rod can be selectively coupled or decoupled from its related drive rail;

means for operatively connecting each of said embroidering implement rods to its related oscillating drive rail;

said operatively connecting means comprising a common switching lever for simultaneously coupling to or decoupling from the related operatively associated drive rail two of said embroidering implement rods which are related to the same embroidery location;

said common switching lever being manually actuatable; and means including an electromagnetic device for automatically actuating said common switching lever.

2. The embroidery machine as defined in claim 1, wherein:

said common switching lever can be manually actuated directly by acting upon said common switching lever.

3. The embroidery machine as defined in claim 1, wherein:

said common switching lever can be actuated manually by means of a manual positioning lever.

4. The embroidery machine as defined in claim 1, wherein:

said electromagnetic device is not actuated when said common switching lever is located in a manually initiated arrested end position; and said arrested end position causing said embroidering implement rods to be decoupled from the related drive rails.

5. The embroidery machines as defined in claim 1, wherein:

said electromagnetic device comprises part of a positioning device for a related one of said switching levers; and said positioning device further comprising a mechanical device operatively associated with said electromagnetic device.

6. The embroidery machine as defined in claim 5, further including:

a pawl lever cooperating with said common switching lever;

said pawl lever being displaceable between a first end position and an intermediate position by means of said electromagnetic device; and said pawl lever being displaceable between said intermediate position and a second end position by means of said mechanical device.

7. The embroidery machine as defined in claim 6, wherein:

said common switching lever having upper and lower positioning arms; and said pawl lever acting upon the lower positioning arm of said common switching lever.

8. The embroidery machine as defined in claim 7, further including:

a permanent magnet arranged at a free end of said pawl lever; and said permanent magnet constantly adhering to an iron core of said electromagnetic device when deenergized.

9. The embroidery machine as defined in claim 6, wherein:

said mechanical device comprising an externally actuatable tilt lever; and said pawl lever being displaceable from said intermediate position into said second end position by pivoting said tilt lever.

10. The embroidery machine as defined in claim 1, wherein:

said operatively connecting means comprising a respective latching element hinged to each of said embroidering implement rods;

a downwardly open coupling groove provided at the free end of each said latching element; and a respective coupling nose provided at each of said drive rails for latching with said coupling groove of the related latching element.

11. The embroidery machine as defined in claim 10, further including:

inclined control surfaces provided at said latching elements;

said common switching lever having a transverse web; and control surfaces provided at said transverse web of said common switching lever cooperating with said inclined control surfaces for decoupling said two embroidery implement rods from their related drive rails.

12. The embroidery machine as defined in claim 10, wherein:

said coupling grooves provided at said latching elements being located essentially in the lengthwise axis of said embroidering implement rods.

13. The embroidery machine as defined in claim 10, wherein:

said coupling grooves and said coupling noses being structured such that they fit into each other in a wedge-shaped fashion; and said coupling grooves and said coupling noses having a wedge angle which is approximately equal to a friction angle thereof.

14. The embroidery machine as defined in claim 1, wherein:

said common switching lever comprising a first manual positoning arm extending upwardly past an upper row of said implement rods; and said common switching lever further comprising a second positioning arm extending downwardly past a lower row of said implement rods.

15. The embroidery machine as defined in claim 1, further including:

manual positioning lever means for releasably arresting said common switching lever in an end position; and said end position causing said embroidering implement rods to be decoupled from their related drive rail.

16. The embroidery machine as defined in claim 1, wherein:

a number of said embroidery locations are combined into a respective block unit and arranged in a bearing housing;

a support rail provided for the embroidery machine; and said bearing housings being exchangeably mounted upon said support rail of said embroidery machine.

* * * * *